United States Patent [19]

Barrow et al.

[11] Patent Number: 4,801,844

[45] **Date of Patent: * Jan. 31, 1989**

[54] FULL COLOR HYBRID TFEL DISPLAY SCREEN

[75] Inventors: William A. Barrow, Beaverton; Richard T. Tuenge, Hillsboro, both of Oreg.

[73] Assignee: Planar Systems, Inc., Beaverton, Oreg.

[ * ] Notice: The portion of the term of this patent subsequent to Jan. 12, 2005 has been disclaimed.

[21] Appl. No.: 116,728

[22] Filed: Nov. 4, 1987

Related U.S. Application Data

[63] Continuation-in-part of Ser. No. 727,663, Apr. 26, 1985, Pat. No. 4,719,385.

[51] Int. Cl.[4] ..... H05B 33/14; H05B 33/22

[52] U.S. Cl. ..... 313/509; 313/506

[58] Field of Search ..... 313/463, 506, 509, 505, 313/512

[56] References Cited

U.S. PATENT DOCUMENTS

| | | | |
|---|---|---|---|
| 4,396,864 | 8/1983 | Suntola et al. | 313/506 |
| 4,689,522 | 8/1987 | Robertson | 313/505 X |
| 4,719,385 | 1/1988 | Barrow et al. | 313/463 |

*Primary Examiner*—David K. Moore
*Assistant Examiner*—K. Wieder
*Attorney, Agent, or Firm*—Chernoff, Vilhauer, McClung & Stenzel

[57] ABSTRACT

A hybrid full color TFEL display device includes a pair of independently addressable matrix arrays on stacked substrates wherein the front substrate includes patterned phosphors arranged as alternating stripes, and the rear substrate includes a single phosphor layer. The rear phosphor layer may be either a red or blue emitter and the front phosphor stripes are either red-green or blue-green. The space between the stacked substrates may be filled with a dyed filler material to improve the chromaticity of the rear substrate phosphor. To achieve a full color spectrum the fill factors of the various phosphors are adjusted to be inversely proportional to respective luminance of each at the driving frequency of the panels.

6 Claims, 2 Drawing Sheets

MONOCHROME PIXEL LUMINANCE OF RED, GREEN & BLUE PHOSPHORS REQUIRED TO ACHIEVE 10 fL AVERAGE LUMINANCE OF WHITE AFTER FILTER WHEN USED IN A HYBRID STRUCTURE AT 180 Hz

| TYPE | HYBRID STRUCTURE COLOR ASSIGNMENT | RED (fL) | GREEN (fL) | BLUE (fL) |
|---|---|---|---|---|
| GB/R | GREEN BLUE / RED | 8.67 | 21.60 | 2.54 |
| BR/G | BLUE RED / GREEN | 8.72 | 21.38 | 2.56 |
| RG/B | RED GREEN / BLUE | 8.73 | 21.62 | 2.52 |
| R/GB | RED / GREEN BLUE | 4.00 | 46.60 | 5.50 |
| G/BR | GREEN / BLUE RED | 18.81 | 9.92 | 5.50 |
| B/RG | BLUE / RED GREEN | 18.84 | 46.58 | 1.17 |

FULL COLOR HYBRID TFEL DISPLAY SCREEN

RELATED APPLICATION

This application is a continuation-in-part of our copending application Ser. No. 727,663 filed Apr. 26, 1985, now U.S. Pat. No. 4,719,385 and assigned to the same assignee.

BACKGROUND OF THE INVENTION

The present invention relates to a thin-film electroluminescent (TFEL) device capable of providing a full color display through the use of a hybrid structure employing stacked independently addressable subpanels, one of which includes patterned phosphor stripes.

Multi-colored TFEL devices have been proposed having one of two basic structures. In the first, an example of which is described in the aforementioned parent application of which this application is a continuation-in-part, independently addressable stacked subpanels emit light of two differing colors. Thus, varying hues in at least a portion of the visible color spectrum are available. In order to provide a full color display, it would be necessary, with this type of architecture, to have three stacked subpanels with each subpanel emitting one of the primary colors. This is impractical because of the transmission losses from the rearmost panel, and because of the parallax error inherent in such a design.

Patterned phosphor stripes arranged in side-by-side relation on a single subpanel are capable of providing a full color display. However, in order to obtain good resolution, a high pixel density must be employed. With a high pixel density, however, the area occupied by each of the phosphor stripes must be smaller, which leads to an unacceptable decrease in luminance.

Recently a hybrid structure has been proposed as shown in Roberson, U.S. Pat. No. 4,689,522, comprising two stacked subpanels forming the front and rear of a laminate structure including a solid phosphor layer and a patterned phosphor layer comprising phosphor stripes of alternate color emitting properties. The two phosphor layers are sandwiched between front and rear column electrodes and share an interiorly disposed set of row or scanning electrodes. The phosphor stripes have uniform widths to form square picture elements. The problem with the foregoing arrangement is the difficulty in driving the panel with the shared common scanning electrode. The front and rear phosphor layers are driven simultaneously and with the same field intensity generated by the common scanning electrode. This arrangement, unfortunately, does not provide for adjustments to deal with the difference in brightness levels between the front and rear phosphor layers which are needed in order to obtain the right color mix for achieving a full color display. Also the fact that the two phosphor layers are contained in a laminate structure and are unseparated except by insulating layers means that the chromaticity of the rear layer will be dependent upon the color emitting properties of the phosphor itself. Thus, a phosphor having the right color hue may not be bright enough and vice versa.

SUMMARY OF THE INVENTION

The present invention provides a full color TFEL display device including a rear subpanel having an independently addressable TFEL matrix array having a solid phosphor layer emitting light of one of the primary colors, and a front subpanel including an independently addressable TFEL matrix array having phosphor stripes arranged in side-by-side alternating color sequence. The phosphor stripes emit the other primary colors not used in the rear matrix array. The two subpanels are separated by a spacer to maintain them in a uniformly spaced-apart stacked relationship, and a filler material is interposed between the front and rear subpanels which has a dye for enhancing the color emitting properties of the phosphor layer of the rear subpanel.

Preferably, the rear subpanel phosphor is a blue light emitter such as $SrS:CeF_3$ and the phosphor stripes of the front subpanel emit red and green light, respectively. A preferred red emitter is $ZnS:SmCl_3$ and a green emitter is ZnS:Tb,F. In order to provide a full color display, it is necessary that the luminescence of the phosphor materials making up the display be mixed in the right proportions, since green emitting phosphors are generally brighter than red emitting phosphors which are, in turn, brighter than the blue emitting phosphors. Thus, the fill factors of the various phosphors are adjusted to be generally inversely proportional to their brightness.

Each of the phosphor stripes is driven by a data electrode, which is overlaid in colinear fashion with each stripe, in combination with scanning electrodes disposed at right angles to the data electrodes to form a pixel matrix. The data electrodes are necessarily made narrow so that only the particular stripe directly underneath each electrode will be energized.

The panel is scanned in line-by-line fashion and the scanning electrodes, which may be wider than the data electrodes, are driven from both ends simultaneously by appropriate driving amplifiers. To reduce flicker, the panel may be symmetrically driven so that alternate scanning electrodes are driven by voltages of alternate polarity. This polarity reverses each image frame so that scanning electrodes that were driven with a positive voltage on the first frame are driven with a negative voltage on the next frame.

It is a primary object of this invention to provide a hybrid TFEL display device using two independently driven, stacked subpanels wherein one of the subpanels includes patterned phosphor stripes.

It is a further object of this invention to provide a hybrid full color TFEL display device utilizing two independently driven subpanels separated by a spacer where the volume between the spacer may include a dyed filler material for increasing the chromaticity of the phosphor on the rear subpanel.

Yet a further object of this invention is to provide a hybrid full color TFEL display using a front patterned phosphor subpanel and a rear single phosphor layer where the areas of the phosphors are chosen as a function of the proportion of each color needed to achieve full color capability and as a function of the brightness of each phosphor material.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
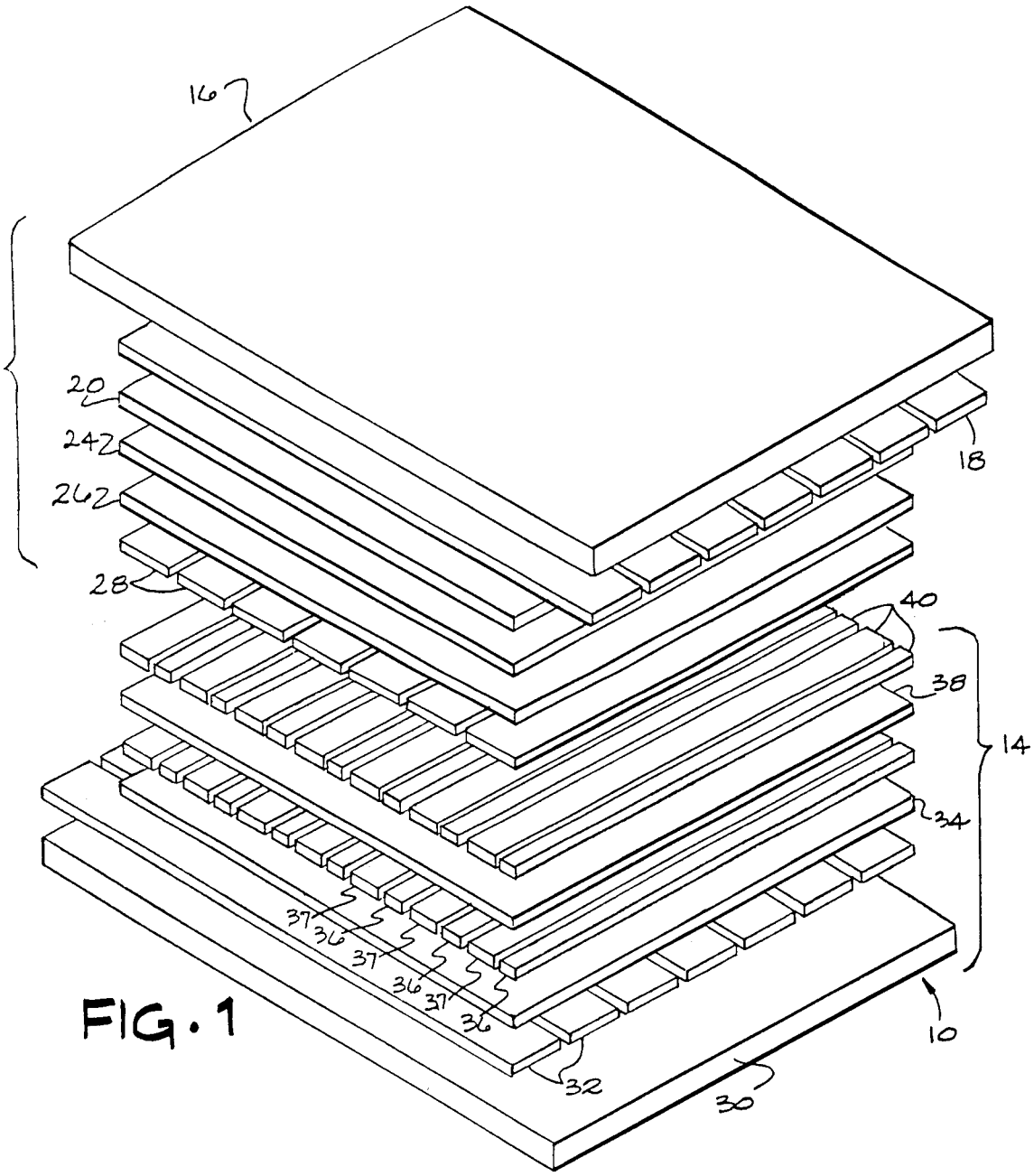
FIG. 1 is an exploded perspective view of the layers of a TFEL device constructed according to the present invention.

Referring now to FIG. 1, a hybrid TFEL device 10 comprises a laminate structure comprising a rear subpanel 12 in a front subpanel 14. The rear subpanel 12 includes a glass substrate 16 onto which is deposited a set of rear scanning electrodes 18. The scanning electrodes 18 are preferably made of some reflecting material such as aluminum, so that light from the rear phosphor layer will be reflected towards the front of the device 10. Deposited on top of the rear scanning electrodes 18 is an insulating layer 20. The insulating layer 20 and a front insulating layer 26 sandwich a solid phosphor layer 24. For reasons that will be explained below, the solid phosphor layer 24 is preferably a blue light emitter such as $SrS:CeF_3$, although it could also be a red emitter such as $ZnS:SmCl_3$. Completing the rear subpanel structure are data electrodes 28 which are placed on the insulating layer 26 at right angles to scanning electrodes 18. The data electrodes 28 should be made of a semi-transparent metal such as gold.

The front subpanel 14 includes a front glass substrate 30 supporting the scanning electrodes 32. Insulating layers 34 and 38 sandwich a layer of patterned phosphor stripes which includes red emitting phosphor stripes 37 which alternate in side-by-side relation with green emitting phosphor stripes 36. The green emitting phosphor may be ZnS:Tb,F. A set of data electrodes 40 are arranged colinearly with each of the patterned phosphor stripes 36, 37 so that one data electrode in the set 40 is dedicated to each of the stripes 36, 37.

The subpanels 12 and 14 are positioned in a stacked spaced-apart relationship by spacers 42 and 44 which define a cavity 46. The spacers should be narrow (10–15 mils) to avoid parallax viewing error. The cavity 46 may be filled with a dyed silicone oil as will be described below.

Figure 2:
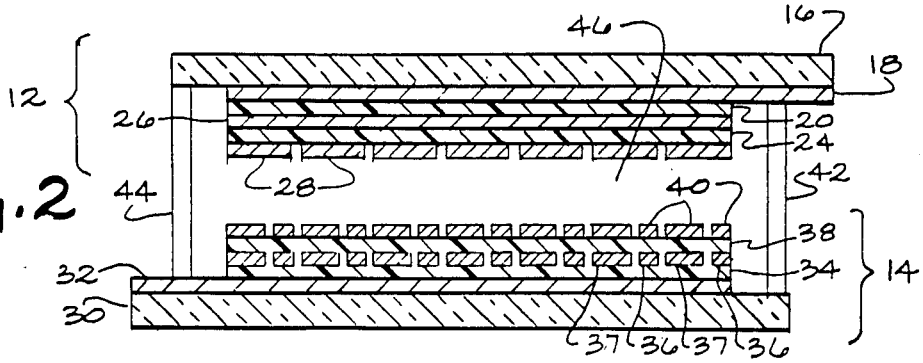
FIG. 2 is a side cutaway view of a hybrid TFEL device constructed according to the present invention.
Figures 3, 4:
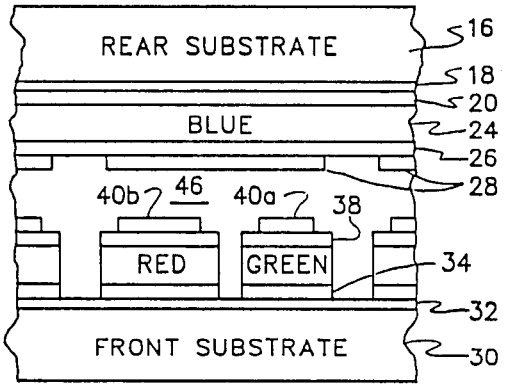
FIG. 3 is a schematic blown-up partial cutaway view of the TFEL device of FIG. 2.
FIG. 4 is a table describing the properties of various combinations of hybrid stacked substrate/patterned phosphor combinations.

FIG. 3 provides a schematic blow-up of a portion of the TFEL device shown in FIG. 2. In order to produce a full color display, it is necessary to have the proper mix of the three primary colors red, green and blue. In a hybrid full color display which includes both a patterned phosphor subpanel and a stacked substrate subpanel, several factors must be considered for the assignment of colors and substrate order. If it is assumed that the rear electrode is 90% reflecting, as in a standard monochrome panel, the light produced by the phosphor deposited on the rear substrate will have both a direct and a reflected component. Other electrodes such as the data electrodes may be semitransparent metal electrodes with a 50% transmission factor. The front electrode, in this case electrode 32, should be constructed of indium tin oxide which has a transmission factor of 85%.

Proper color mix requires that the device have the capability for producing white light at a specified luminance. Experimentally it has been determined that in order to achieve ten foot lamberts' average luminance, the percentages of the primary colors required from the display are: red 26.5%, green 65.8%, blue 7.7%. These proportions are about two-thirds green, one-fourth red and one-twelfth blue. They are achieved by adjusting the emitting area or "fill factor" of each pixel in accordance with each color-emitting phosphor's brightness. The pixel area is defined by the area of the scanning and data electrodes that intersect in the plane of the viewer's line of sight which creates a matrix of rectangular areas separated by gaps. This is shown in cross section in FIG. 3.

Although a white emitting screen would be comprised of approximately 65% green light, the green phosphor stripes 36 are the narrowest because the thin-film phosphors that emit green light are currently some of the most efficient. Red emitting phosphors are lower in efficiency, and therefore the red emitting stripes 37 cover a wider area, even though less red light is needed to made up the white light composite. The largest area is occupied by the blue phosphor 24, which is on the rear subpanel, because it is the least efficient of all the color emitting phosphors, and because of transmission losses through the front subpanel. These percentages are expressed often in terms of fill factors, which represent the percentage of the screen are filled with a particular color-emitting phosphor. For example, in the preferred embodiment of FIG. 3 the fill factor for blue is 0.85. This means that 85% of the visible screen area is occupied by a blue emitting phosphor. Similarly, the fill factor for red is 0.51 and the fill factor for green is 0.26. These fill factors could fluctuate in either direction depending upon the particular efficiencies of the phosphor material chosen. For example, the fill factor for blue could be in a range between 0.80 and 0.90; red could lie between 0.46 and 0.56 and green could lie between 0.21 and 0.31. Thus the fill factor is approximately inversely proportional to the efficiency or brightness of the phosphor.

The preferred embodiment shown in FIG. 3 is not the only available possibility, however. The table of FIG. 4 gives results for various color assignments in the hybrid configuration. The colors in the front plane are stated first with the rear plane color separated by a slash. The table gives the phosphor performance required in terms of the pixel luminance attainable if the phosphor were used in a standard monochrome test structure with an aluminum reflecting rear electrode and driven at 180 Hz.

Since the table gives minimum pixel brightness required for each phosphor, structures with low table values are desirable. As might be expected, if only one phosphor is very deficient in luminance, while the others have more than enough brightness, then consideration should be given to placing it on the first substrate by itself. The transmission from the front substrate and the fill factor are both maximized. For example, the lowest red luminance requirement is for the R/GB hybrid but both the green and blue have maximum requirements. This configuration does not match the present state of phosphor development as well as the patterned front substrate embodiment, since the brightest phosphor green is not matched in luminance by either the red or blue phosphors at this time.

If one phosphor is several times as bright as the other two phosphors, then the best structure may be to put the two dimmer phosphors on the patterned front substrate. Further balancing of the relative fill factors on the patterned front substrate could allow the brightest white display to be achieved by assigning fill factors that are inversely proportional to the phosphor luminances. In the table of FIG. 4 the first three cases have essentially the same performance because the overall light factors are balanced by the front and rear planes. That is, the fill factors just compensate for the transmission differences. The choice of color assignments can then be made on other grounds. For example, if filtering of the blue emission were under consideration to improve its chromaticity, the RG/B configuration would lend itself readily to blue dye in the optical matching fluid between the substrates. This may be necessary because the best blue emitter, $SrS:CeF_3$, emits blue-green light, and what is needed is a wellsaturated blue. This is in fact the preferred embodiment shown in FIG. 3.

Another choice might be to position the phosphors for the best processing advantage. As further progress is made in developing brighter phosphors, the configuration of choice may change to take the best advantage of the opportunity to increase the overall luminance of the display. With the panel of FIG. 3 the best configuration places blue on the rear of subpanel 12. This allows the gap 46 between the front and rear substrates to be filled with a dyed protective oil which enhances the blue emitting phosphor's chromaticity. It is the least efficient of the phosphors and it has the largest fill factor, but it must provide one one-twelfth of the necessary white screen composite. Another good choice would be GB/R which provides nearly the same performance. In such a case, a yellow emitting phosphor could actually be used on the rear subpanel with a red dye used in the oil. Since yellow has a large red component, the yellow tint would be largely filtered but a more efficient phosphor could then be used on the rear subpanel. The fill factors of the green and blue components on the front subpanel could then be adjusted to achieve the proper mix for producing a white screen.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A full color TFEL display device comprising:

(a) a rear subpanel comprising an independently addressable TFEL matrix array including a solid phosphor layer emitting light of one of the primary colors;

(b) a front subpanel comprising an independently addressable TFEL matrix array including phosphor stripes arranged in side-by-side alternating color sequence and each emitting one of the two primary colors not used in the rear matrix array, respectively;

(c) spacer means separating said rear and front subpanels to maintain said subpanels in uniformly spaced apart stacked relationship; and (d) a filler material interposed between the front and rear subpanels having a dye for enhancing the color emitting properties of the phosphor layer of the rear subpanel.

2. The full color TFEL device of claim 1 wherein the phosphor layor of the rear subpanel emits blue light and the phosphor stripes of the front subpanel emit red and green light, respectively.

3. The full color TFEL device of claim 2 wherein the fill factors of the respective phosphors are inversely proportional to their luminance at a given driving frequency.

4. The full color TFEL device of claim 3 wherein the phosphor stripes on the front subpanel have differing widths, the red emitting stripes being wider than the green emitting stripes.

5. The full color TFEL device of claim 4 wherein the blue emitting phosphor layer has a fill factor of between 0.80 and 0.90, the red emitting phosphor stripes have a fill factor of between 0.46 and 0.56 and the green emitting phosphor stripes have a fill factor of between 0.21 and 0.31.

6. The full color TFEL panel of claim 5 wherein the blue emitting phosphor layer has a fill factor of approximately 0.85, the red emitting phosphor stripes have a fill factor of approximately 0.51 and the green emitting phosphor stripes have a fill factor of approximately 0.26.

* * * * *

UNITED STATES PATENT AND TRADEMARK OFFICE

CERTIFICATE OF CORRECTION

PATENT NO. : 4,801,844

DATED : January 31, 1989

INVENTOR(S) : William A. Barrow et al.

It is certified that error appears in the above-identified patent and that said Letters Patent is hereby corrected as shown below:

| | | |
|---|---|---|
| Col. 1, | Line 37 | Change "Roberson" to --Robertson--. |
| Col. 4, | Line 15 | Change "made" to --make--. |
| Col. 5, | Line 10 | Change "wellsaturated" to --well-saturated--; |
| | Line 24 | Change "one" (first occurrence) to --only--. |

Signed and Sealed this

Thirty-first Day of July, 1990

*Attest:*

*Attesting Officer*

HARRY F. MANBECK, JR.

*Commissioner of Patents and Trademarks*